United States Patent [19]

Tsuge et al.

[11] Patent Number: 4,564,119

[45] Date of Patent: Jan. 14, 1986

[54] ALUMINUM CAN END

[75] Inventors: Mitsuo Tsuge, Mishima; Shigeru Kohmura; Keiichi Sugiyama, both of Shizuoka; Hisao Saitoh, Fuji; Shigenori Saitoh, Ihara, all of Japan

[73] Assignee: Nippon Light Metal Co., Ltd., Tokyo, Japan

[21] Appl. No.: 679,383

[22] Filed: Dec. 7, 1984

[51] Int. Cl.[4] ..... B65D 17/34

[52] U.S. Cl. ..... 220/270

[58] Field of Search ..... 220/266, 269–273

[56] References Cited

U.S. PATENT DOCUMENTS 3,980,201 9/1976 Keiji ..... 220/270

4,403,710 9/1983 Hirota et al. ..... 220/270

*Primary Examiner*—George T. Hall

*Attorney, Agent, or Firm*—Oblon, Fisher, Spivak, McClelland & Maier

[57] ABSTRACT

The can end is formed with a circular severing score for severing the area defined thereby from the can end by pulling a manipulating tab secured within the area defined by the score at a position adjacent thereto. In order to increase the pressure resisting strength against the internal pressure caused by the content in the can, the can end is made from a thin aluminum alloy sheet having the yield strength in the range of 24–29 kgf/mm$^2$ as well as the elongation equal to or greater than 6%, while the aperture rate defined by the ratio of the area formed within the score with respect to the total area of the can end is made at least equal to or greater than 60% so that the pressure resisting strength is kept substantially at least 5 kgf/cm$^2$. In order to more advantageously maintain the high pressure resisting strength of the can, score is located at a position spaced from the inner periphery of the bottom of the frustoconical portion at least a distance equal to or greater than 1 mm inwardly of the area of the can end, to make the inner radius of curvature of the corner formed around the inner periphery of the bottom of the frustoconical portion equal to or less than 0.5 mm, and to make the taper angle of the frustoconical portion of the can end equal to or less than 10°. An auxiliary score having a score residual smaller than that of the score for severing the area defined thereby from the can end may be formed outwardly or inwardly of the score for severing. The score residual of the can end may be preferably increased from the thinnest portion adjacent to the position where the tab is provided while a plurality of elongated ridges or grooves may be formed within the area defined by the score substantially perpendicular to the line passing through the tab and the center of the can end in order to avoid rapid severing of the area defined by the score from the can end so as to prevent spilling of the content out of the can when the can end is being opened. All these measures are effective to most advantageously enhance the pressure resisting strength of the can end.

6 Claims, 25 Drawing Figures

ALUMINUM CAN END

BACKGROUND OF THE INVENTION

The present invention relates to improvements in an aluminum alloy can end of the aluminum alloy can which can end is formed with a score for severing the area defined thereby from the can end so as to provide an opening for taking out the content of the can, and, more particularly, to a can end of the type described above which has a high pressure resisting strength against the internal pressure caused by pressurized liquid or pressure generating liquid contained in the can such as carbonated beverage including beer, for example, while it provides a great aperture rate of the can end as defined by the ratio of area of the opening with repect to the total area of the can end such as ranging equal to or greater than 60%.

In an aluminum alloy can for containing beer therein which is being commonly sold at present, the body of the can having a bottom integrally formed therewith has the shape similar to that of a conventional aluminum alloy can for containing juice therein and the body is made of an aluminum alloy sheet of Japanese Industrial Standars (referred to as JIS hereinafter) A-3004 P.H-19 having the thickness of about 0.35 mm and formed by the deep drawing and ironing process, while the can end of the can which is sealingly curled with its peripheral portion toegeher with the peripheral upper open end of the body is made of an aluminum alloy sheet of JIS A-5052 P.H-38 having the thickness of about 0.30 mm (in case of a can having the internal volume of 350 ml), for example. The configuration of the periphery of the can end is in the frustoconical shape and a teardrop-shaped severing score is formed in the can end by the pressing process, and a manipulating tab having a gripping hole formed therein is secured to the severable area defined by the score of a relatively small aperture by a rivet located at a position near the tip of the teardrop-shape of the severable area, whereby the severable area can be removed from the can end by pulling the tab apart from the can end so that the rivet first breaks off the tip portion of the teardrop-shape of the severable area to which the rivet is secured along the score thereby providing an opening for taking out the content of the can.

In general, beer is said to taste most delicious when one gulps down the beer or takes a long noisy drink of the beer after it is cooled to a temperature of about 5°–10° C.

The discharge rate of beer out of a prior art can through the opening formed in the can end is low, so that good taste of beer can not be obtained by using the prior art can presently produced and sold. This tendency is enhanced as the volume of the can decreases, even though the relationship between the aperture rate and the volume of the can containing beer therein is taken into consideration.

In order to solve the above problem, efforts have been made to increase the aperture rate of a can. However, since beer contains carbonic acid gas so that the internal pressure of a can containing therein beer will sometimes rise to about 5 kgf/cm$^2$ or more in the summer season, for example, when the can directly receives the sunlight, construction of a can end has not ever been developed which can satisfy the requirements such as to sufficiently resist against such a high internal pressure and yet to be easily opened while it has a large aperture rate for achieving good taste of beer, and can be produced at a lower cost.

SUMMARY OF THE INVENTION

It is an object of the present invention to provide a novel and useful construction of an aluminum alloy can end of an aluminum alloy can for containing therein pressurized liquid or carbonated beverage such as beer, which can end avoids the above described disadvantages of the prior art can end.

Another object is to provide an aluminum alloy can end of an aluminum alloy can adapted to sealingly contain pressurized liquid or carbonated beverage such as beer which can sufficiently resist against a high internal pressure of the can end which is formed with a score for severing the area defined thereby from the can end so as to provide an opening of sufficiently large area for taking out the content from the can to afford a superior taste of the content such as beer while it can be manufactured at a lower cost.

The present inventors have found out by a number of comparison tests of the cans produced in accordance with the present invention with the prior art cans that a remarkable effectiveness can be obtained in order to enhance the pressure resisting strength of the can end and to render the removal of the area defined by the score for providing the opening easier while a great aperture rate is achieved by virtue of the fact that, under the conditions of the aperture rate being equal to or greater than 60% and the pressure resisting strength being at least 5 kgf/cm$^2$, an aluminum alloy having the yield strength in the range of 24–29 kgf/mm$^2$ and the elongation equal to or greater than 6% (JIS A 5052–H-38, for example) is used for making the can end and the following two conditions that the distance between the score and the internal corner formed along the sealingly curled peripheral portion of the can end is made equal to or greater than 1 mm and that the inner radius of curvature of the internal corner formed along the sealingly curled peripheral portion of the can end is equal to or less than 0.5 mm are adopted as the indispensable requirements for constructing the can end of the present invention while either one or any combination of the following three conditions is or are adopted for advantageously constructing the can end of the present invention, as the diameter of the can is increased: the conditions being that the taper angle of the sealingly curled peripheral portion of the can end in the frustoconical shape is made equal to or less than 10 degree., that an auxiliary score having the score residual greater than that of the severing or main score is provided between the severing score and the internal corner formed along the inner periphery of the frustoconical sealingly curled portion of the can end in order to afford an appropriate deformation of the can end for assisting the severing action of the severable area along the severing score, and that an auxiliary score having the score residual greater than that of the severing score is formed in the severable area in order to afford an appropriate deformation of the can end for assisting the severing action of the severable area along the severing score. Further, a plurality of parallel elongated ridges or recessed grooves are preferably provided in the severable area in the direction perpendicular to the direction of severing the severable area in order to render the severable area to be easily bent around the ridges or the grooves thereby preventing rapid removal of the severable area tending to cause spilling of the content out of the can as the aperture rate increases.

The present invention is equally applicable to the cans both of the so-called flat-type can end and the countersinktype can end, and particularly to the cans of the small countersink-type can end proposed in accordance with the present invention.

The above objects are therefore, achieved in accordance with the characteristic feature of the present invention by the provision of an aluminum alloy can end of an alluminum alloy can consisting of a cylindrical body having a closed bottom and an upper open end and made of a thin aluminum alloy sheet and a can end made of a thin aluminum alloy sheet with the peripheral edge thereof being sealingly curled together with the periphery of the upper open end of the body of the can so as to form an upwardly diverging frustoconical portion along the periphery of the can end thereby forming a hermetically sealed vessel adapted to sealingly contain therein pressurized liquid such as carbonated beverage or beer, the can end being formed with a circular score within the area of the surface of the can end along the periphery thereof so as to form a severable portion from the can end, a manipulating tab being secured at the proximal end or an appropriate position thereof to the can end within the area defined by the score adjacent thereto so as to permit the area defined by the score to be severed from the can end by pulling the manipulating tab apart from the can end, the can end being characterized in that it is formed of an aluminum alloy sheet which is so regulated that it has the yield strength in the range of 24–29 kgf/mm$^2$ and the elongation equal to or greater than 6%, while the aperture rate as defined by the ratio of the area defined by the score with respect to the total area of the can end is selected to be at least equal to or greater than 60%, so that the pressure resisting strength of the can end is kept to be substantially at least 5 kgf/cm$^2$, the score being selected to be located at a position spaced from the inner periphery of the bottom of the frustoconical portion of the can end at least a distance equal to or greater than 1 mm inwardly of the area of the can end, while the inner radius of the carvature of the corner formed at the periphry of the bottom of the frustoconical portion is selected to be in the range equal to or less than 0.5 mm and up to the minimum value capable of being achieved, the pressure resisting strength of the can constructed as described above being found to be remarkably increased in comparison with the prior art cans as the score residual increases.

In accordance with a further feature of the present invention, the taper angle of the frustoconical portion formed by the peripheral portion of the can end is selected to be equal to or less than 10°.

In accordance with a still further feature of the present invention, an auxiliary score may be formed between the main score, i.e. the score for severing the area therein from the can end and the periphery of the bottom of the frustoconical portion of the can end, the score residual of the auxiliary score being made greater than that of the main score for appropriately deforming the can end in order to assist the severing operation by the main score.

Alternatively, at least an auxiliary score having the score residual greater than that of the main score may be formed within the area defined by the main score. In this case, the distance between the auxiliary score and the main score at the nearest position therebetween is selected to be in the range of 3.2 to 15 mm in order to obtain most advantageous condition for enhancing the pressure resisting strength of the can end.

In place of the auxiliary score, an annular groove may be formed on the outer or inner surface of the can end in order to achieve the similar results, the residual thickness at the groove being made smaller than the score residual of the main score.

In accordance with a further characteristic feature of the present invention, the score residual of the main score may be made the thinnest at the position adjacent to the portion to which the tab is secured, the amount of the score residual being gradually on stepwise increased in both peripheral directions along the score toward the position most remote from the above described adjacent position in order to prevent the rapid severing of the area defined by the main score from the can end so as to avoid spilling of the content when the can end is being opened.

In accordance with a still further characteristic feature of the present invention, a plurality of elongated parallel ridges or recessed grooves may be formed in the area of the can end, preferably at about the center thereof, and the ridges or the grooves are oriented in the direction substantially perpendicular to the line passing through the sharpened tip of the tab and the gripping hole thereof or the center of the can end so that the area to be severed from the can end can be easily bent about the ridges or grooves so that the gradual severing of the area defined by the score is insured so as to avoid the spilling of the content out of the can which might occur when no such ridges or grooves are provided.

The can end described above has a flat surface over the entire area defined by the peripheral corner of the frustoconical portion of the can end, but the can end may be formed with a relatively large counter-sink portion along the periphery of the frustoconical portion of the can end recessed inwardly from the flat surface of the area defined by the score.

Alternatively, a small annular countersink portion is preferably formed along the peripheral corner of the frustoconical portion which is recessed inwardly of the can body from the flat surface of the area defined by the score for severing in order to more effectively enhance the pressure resisting strength of the can end.

In this case, the inner radius of the countersink portion in cross-section may be made equal to or less than 0.6 mm and the depth thereof recessed inwardly of the can body from the flat surface of the area defined by the scope for severing is made equal to or less than 2 mm, while the height of the frustoconical portion of the can body is made equal to or less than 10 mm and the diverging angle of the frustoconical portion with respect to the vertical line may be made equal to or less than 15°.

All the above constructions are obtained by the present inventors on the basis of numerous comparison tests with the prior art cans.

DETAILED DESCRIPTION OF THE PREFERRED EMBODIMENTS

Figure 1:
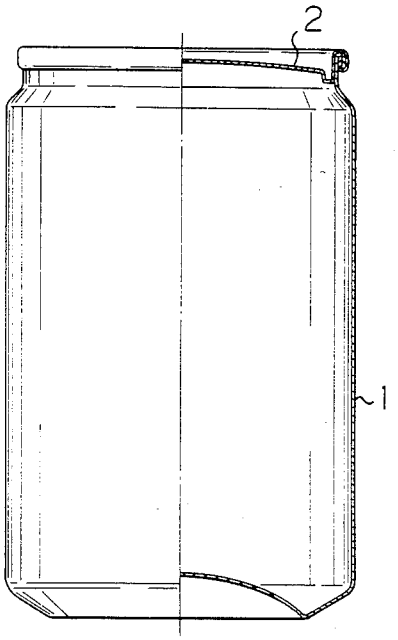
Fig. 1 PRIOR ART
FIG. 1 is a side elevational view with a half portion in cross-section showing a prior art aluminum alloy can.
Figure 2:
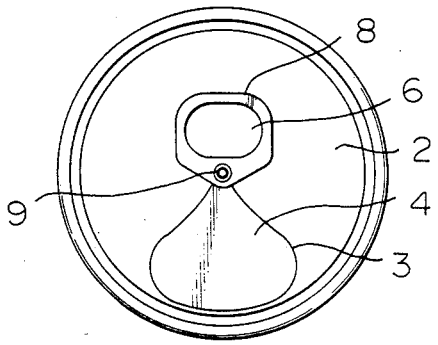
Fig. 2 PRIOR ART
FIG. 2 is a plan view of FIG. 1.

FIGS. 1 and 2 show an example of a conventional aluminum alloy can for containing therein pressurized liquid such as beer. The can consists of a body 1 having a closed bottom integrally formed therewith and made of an aluminum alloy sheet of JIS A-3004 P.H-19 having the thickness of 0.35 mm, for example, and a can end 2 made of an aluminum alloy sheet of JIS A-5052 P.H-38 having the thickness of 0.31 mm with the peripheral portion being sealingly curled together with the upper peripheral open end of the body 1 so as to form a hermetically sealed vessel. The can end 2 is formed with a teardrop-shaped severing score 3 and a manipulating tab 8 having a gripping hole 6 is attached to the severable area 4 defined by the score 3 by a rivet 9 at the tip of the teardrop-shaped area 4 so that the area 4 can be removed from the can end 2 by pulling off the tab 8 from the can end 2, the severing being commenced at the portion adjacent to the rivet along the score 3 and entirely of the score 3 thereby forming an opening for taking out the content of the can. As previously described, the conventional can end 2 has a relatively small severable area 4 for forming the opening, and, therefore, good taste of beer can not be obtained.

Now, the preferred embodiments of the present invention will be described in detail hereinafter with reference to FIGS. 3–25.

Figure 3:
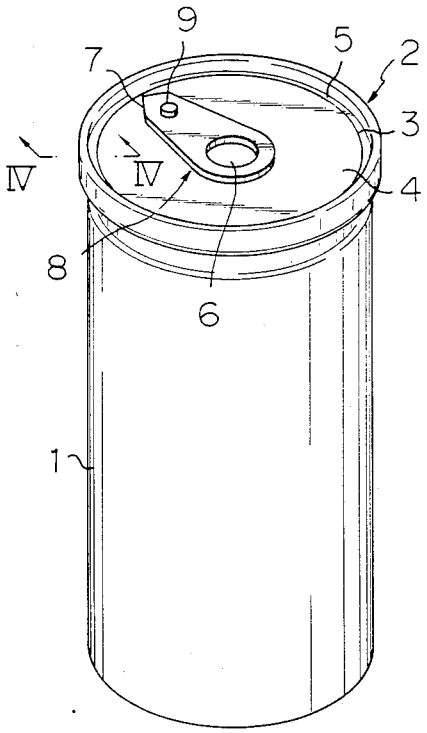
FIG. 3 is a perspective view showing the aluminum alloy can incorporating the can end made in accordance with the present invention.
Figure 4:
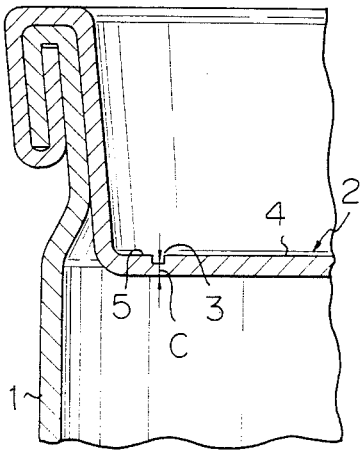
FIG. 4 is a fragmentary enlarged cross-sectional view as seen in the direction IV—IV indicated in FIG. 3.

With reference to FIGS. 3 and 4, the aluminum alloy can incorporating the present invention includes a body 1 having a closed bottom and an upper open end similar to that shown in FIG. 1 and a can end 2 with its peripheral portion being sealingly curled together with the peripheral portion of the upper open end of the body 1 so as to form an upwardly diverging frustoconical portion along the periphery of the can end 2 thereby forming a hermetically sealed vessel for sealingly storing therein pressurized liquid such as carbonated beverage or beer.

In order to permit the content in the can to be taken out therefrom so that one can drink the content of the can, a circular severing score 3 is formed in the can end 2 along the periphery thereof for severing the severable area 4 defined by the score 3 from the can end 2 so as to leave the remaining annular portion 5 in the can end 2, which forms the opening for taking out the content. A manipulating tab 8 provided with a sharpened end 7 at its proximal end and a gripping hole 6 at its opposite end is attached to the severable area 4 at a position adjacent to the proximal end 7 or an appropriate position thereof by means of a rivet 9 secured thereto at a position adjacent to the score 3 within the area 4, the sharpened proximal end 7 being adapted to pierce a portion of the area 4 adjacent to the score 3 thereby permitting the severable area 4 to be severed from the can end 2 beginning at a position in the score 3 adjacent to the rivet 9 along the score 3 by gripping the gripping hole 6 with a finger of the operator and pulling the tab 8 apart from the can end 2 to provide an opening defined by the score 3 for permitting the content in the can to be easily taken out and drunk by a person in the manner affording the most delicious taste of the content in the can such as beer.

The present inventors have made a numerous tests under the conditions that the thickness t of the aluminum alloy sheet from which the can end 2 is made was selected to be 0.30–0.32 mm and the score residual C of the can end 2 (FIG. 4) was selected to be 0.10 mm so as to find out under what conditions in the relationship between the yield strength $\sigma_{0.2}$ kgf/mm$^2$ (0.2% elongation) and the elongation $\delta$% of the aluminum alloy sheet the highest pressure resisting strength can be achieved.

The results of the tests were as follows:

| Thickness t (mm) | Yield Strength $\sigma_{0.2}$ (kgf/mm$^2$) | Elongation $\delta$ (%) | Results |
|---|---|---|---|
| 0.32 | 31.4 | 9.8 | non-effective |
| 0.32 | 29.4 | 11.4 | — |
| 0.32 | 27.4 | 13.6 | effective |
| 0.32 | 29.4 | 8.2 | — |
| 0.30 | 26.1 | 8.1 | effective |
| 0.32 | 26.1 | 8.1 | effective |

wherein — indicates either effective or non-effective

Figure 5:
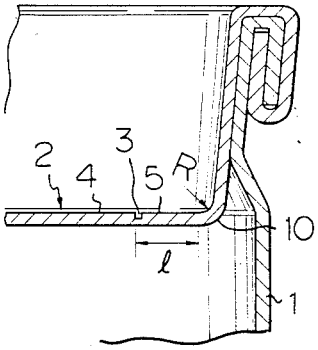
FIG. 5 is a fragmentary enlarged cross-sectional view showing the distance between the score and the corner formed around the bottom of the frustoconical portion of the can end to be set in accordance with the present invention.
Figure 6:
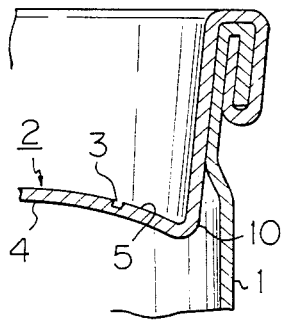
FIG. 6 is a fragmentary cross-sectional view similar to FIG. 5 but showing the deformed state of the can end when an increased internal pressure is applied thereto.
Figure 7:
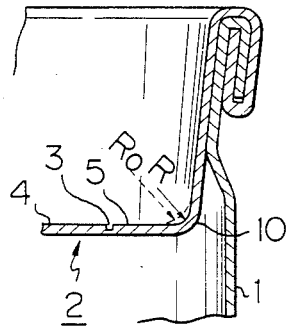
FIG. 7 is a fragmentary enlarged cross-sectional view showing the inner radius of curvature formed at the inner corner of the periphery of the bottom of the frustoconical portion of the can end of the present invention.

From the above, it has been proved that, in order to insure the easy severing action of the area 4 from the can end 2 for providing the opening having the aperture rate greater than 60% for enabling drinking of the content in the can with good taste, the aluminum alloy sheet from which the can end 2 is made must have the yield strength $\sigma_{0.2}$ in the range of 24–29 kgf/mm$^2$ and the elongation $\delta$ equal to or higher than 6%, the severing score 3 being selected to be spaced from the corner 10 formed along the periphery of the bottom of the frustoconical portion of the can end 2 by a distance l equal to or greater than 1 mm, as shown in FIGS. 5 and 6 contrary to the prior art cans having the distance l smaller than 1 mm, while the inner radius of curvature R at the corner 10 of the bottom of the frustoconical portion of the can end 2 is selected to be equal to or less than 0.5 mm as shown in FIG. 7.

As is noted, FIG. 6 shows the state of the can end 2 of FIG. 5 after an increased internal pressure is applied thereto. As is clearly shown in FIG. 6, the positioning of the score 3 apart from the corner 10 by a distance l equal to or greater than 1 mm seems to render the configuration of the can end to assume the form like the countersinktype, thereby increasing the pressure resisting strength.

The above range of the yield strength $\sigma_{0.2}$ is selected so as to insure the security for the pressure resisting strength in consideration of the variation in the mechanical property of the aluminum alloy sheet from which the can end is formed.

As described above, the present invention provides an aluminum alloy can enabling to provide an aperture rate greater than 60% for enhancing the good taste of the content such as beer and permitting the area within the score to be easily severed while it can bear against the internal pressure of at least 5 kgf/cm$^2$ which might occur when the can directly receives the sunlight in the summer season and it can be manufactured at a low cost.

Figure 8:
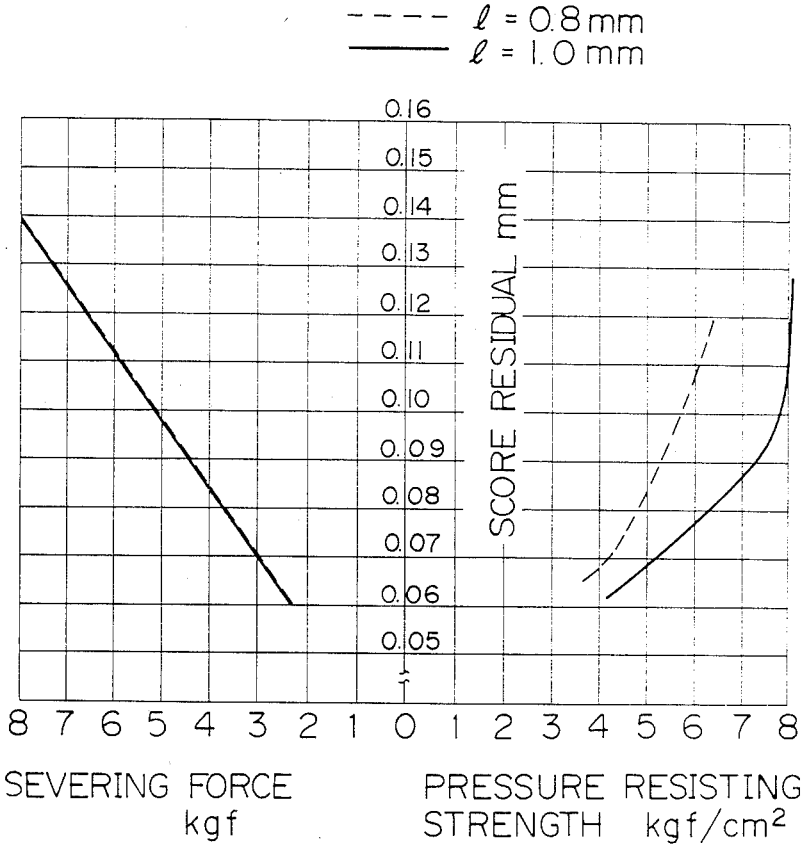
FIG. 8 is a diagram showing the relationship between the severing force of the severable area defined by the score as well as the pressure resisting strength of the can end and the score residual of the can end when the distance between the score and the corner around the bottom of the frustoconical portion of the can end is set in accordance with the present invention.

FIG. 8 shows the results of the comparison tests wherein the can end of the present invention made of an aluminum alloy of JIS A-5052, H-38 and having the numerical properties or the data: t=0.32 mm, $\sigma_{0.2}$=29 kgf/mm$^2$, $\delta$=6%, the taper angle $\sigma$ of the frustoconical portion of the can end=13°, the inner radius R of the bottom of the frustoconical portion=0.5 mm, the diameter of the score=44.5 mm, the inner diameter of the can end=47.57 mm, the distance between the bottom periphery of the frustoconical portion and the score l=1.0 mm were compared with the prior art cans made of the same aluminum alloy and having the same numerical properties or the data of the can end as those of the present invention except that l is selected to be 0.8 mm. The ordinate in FIG. 8 shows the score residual of the can end and the abscissa shows toward the left the severing force and toward the right the pressure resisting strength, while the solid line shows the data of the cans having l=1.0 mm of the present invention and the broken line shows the data of the prior art cans having l=0.8 mm. As seen from FIG. 8, the severing force of the present invention and the prior art cans are substantially the same with each other, but the pressure resisting strength of the present invention is greatly increased in comparison with the prior art cans. The pressure resisting strength is found to be slightly lowered as the diameter of the can end increases.

Figure 9:
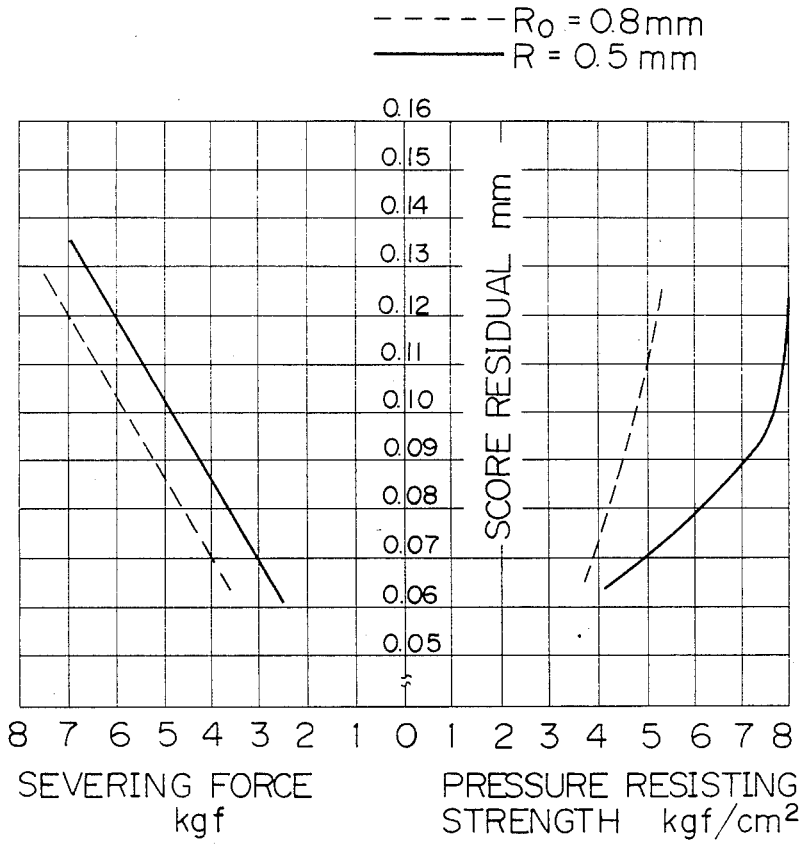
FIG. 9 is a diagram showing the relationship between the severing force of the severable area defined by the score as well as the pressure resisting strength of the can end and the score residual of the can end when the inner radius of curvature of the corner around the bottom of the frustoconical portion of the can end is set in accordance with the present invention.

FIG. 9 shows the results of the comparison tests wherein the cans of the present invention having the can end made of an aluminum alloy of JIS A-5052, H-38 and having the numerical properties or the data: $\sigma_{0.2}$=29 kgf/mm$^2$, $\delta$=6%, t=0.32 mm, l=1 mm, $\sigma$=13°, the diameter of the score=44.5 mm, the inner diameter of the can end=47.5 mm, and R=0.5 mm were compared with the prior art cans having the same numerical properties or the data as those of the present invention except that the inner radius $R_o$ is selected to be 0.8 mm. The ordinate shows the score residual and the abscissa shows toward the left the severing force of the severable area and toward the right the pressure resisting strength of the can end, while the solid line shows the cans of the present invention having the inner radius of curvature R equal to 0.5 mm and the broken line shows the prior art cans having the inner radius of curvature Ro of 0.8 mm. As shown in FIG. 9, the severing force of the present invention is reduced in comparison with the prior art cans and the pressure resisting strength of the cans of the present invention is remarkably increased in comparison with the prior art cans. It is also found that the pressure resisting strength of the present invention tends to be increased as the radius of curvature R is reduced. The pressure resisting strength is found to be slightly lowered as the diameter of the can end increases.

Figure 10:
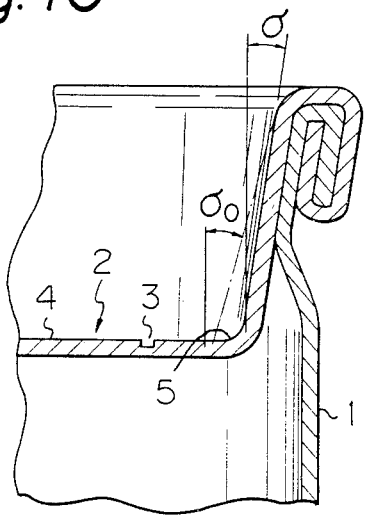
FIG. 10 is a fragmentary enlarged cross-sectional view showing the taper angle of the peripheral frustoconical portion of the can end of the present invention.

Further, in acceptance with another feature of the present invention the taper angle $\sigma$ of the frustoconical portion of the inner peripheral portion of the can end is preferably selected to be equal to or less than 10°, i.e. $\sigma$=10°, as shown in FIG. 10 in order to more effectively increase the pressure resisting strength of the can end 2.

Figure 11:
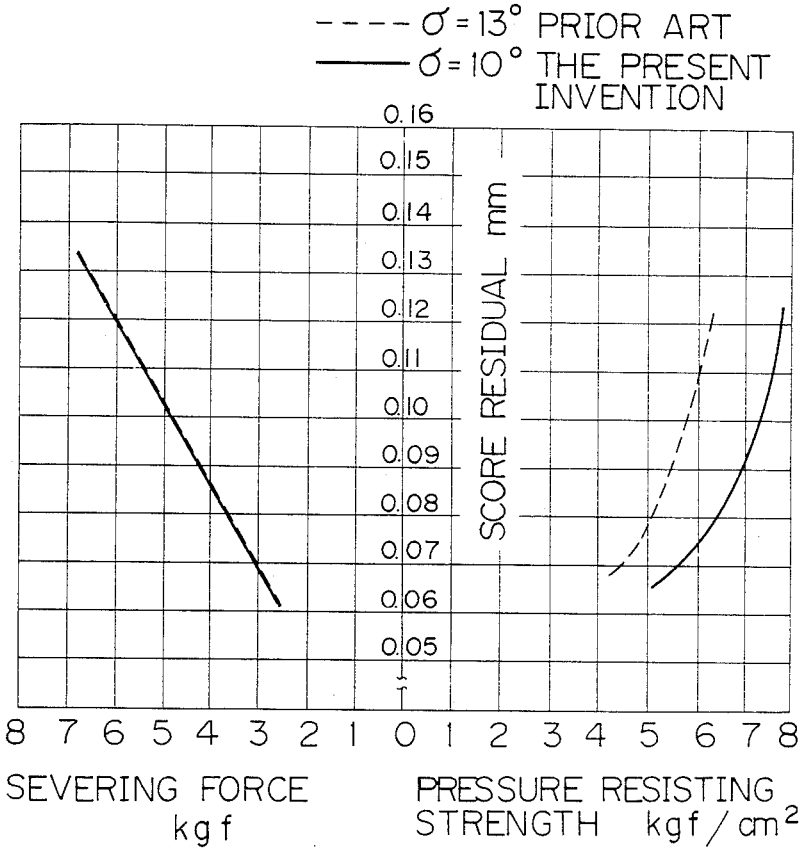
FIG. 11 is a diagram showing the relationship between the severing force of the severable area defined by the score as well as the pressure resisting strength of the can end and the amount of the score residual of the can end when the taper angle is set in accordance with the present invention.

The present inventors made a numerous comparison tests of the cans of the present invention having the same numerical properties or the data as given in FIG. 9 but having the taper angle $\sigma$ of 10° with the prior art cans made of the same aluminum alloy and having the same thickness of the can end and the taper angle $\sigma$° of substantially 13°. The results are shown in FIG. 11. In FIG. 11 the ordinate indicates the score residual of the can end and the abscissa shows toward the left the severing force of the area defined by the score and the pressure resisting strength toward the right, while the curve of the solid line shows the data of the cans of the present invention and the curve of the broken line shows the data of the prior art cans. As shown in FIG. 11, the severing force of both the present invention and the prior art cans has the same value of about 3.6 kgf when the thickness of the can end is 0.32 mm and the score residual is 0.08 mm, for example, whereas the pressure resisting strength of the cans of the present invention is about 6.4 kgf/cm$^2$ which is about 1.5 kgf/cm$^2$ greater than the pressure resisting strength of the prior art cans of about 5 kgf/cm$^2$.

As previously described, the present invention described hereinbefore equally applies to both the flat type can end having the flat surface over the entire area of the can end and the so-called countersink type can end having a relatively large annular countersink around the periphery of the can end recessed in the can body from the plane of the area defined by the score.

Figure 12:
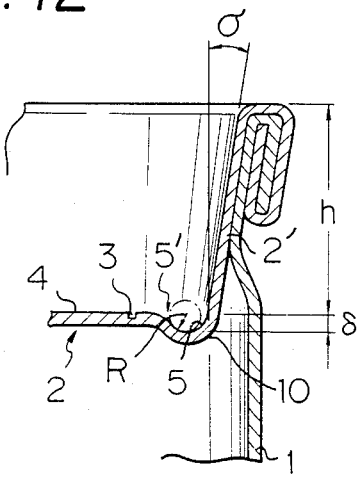
FIG. 12 is a fragmentary cross-sectional view showing the construction of the small countersink type can end.

The present inventors have found that the pressure resisting strength of the can end can be remarkably increased in comparison with the flat type can end, when a small countersink is formed around the periphery of the can end as described below in connection with Fig.12.

To this end, an annular countersink 5' is formed in the annular area 5 along the periphery of the bottom of the frustoconical portion 2' of the can end. The countersink 5' has an inner radius R in cross-section equal to or less than 0.5 mm, i.e., $R \leqq 0.5$ mm, and it extends inwardly of the can body from the plane of the severable area 4 by a depth $\delta$ equal to or less than 2 mm, while the height h of the frustoconical portion is selected to be equal to or less than 10 mm. In this case, the taper angle $\sigma$ of the frustoconical portion 2' may be made equal to or less than 10°.

The can end of the above configuration was compared with the flat type can end of the same material and thicknes and the results showed that, when the score residual is selected to be equal to or greater than 0.1 mm, the pressure resisting strength is remarkably increased, while the severing force is kept substantially the same with each other.

Figure 13:
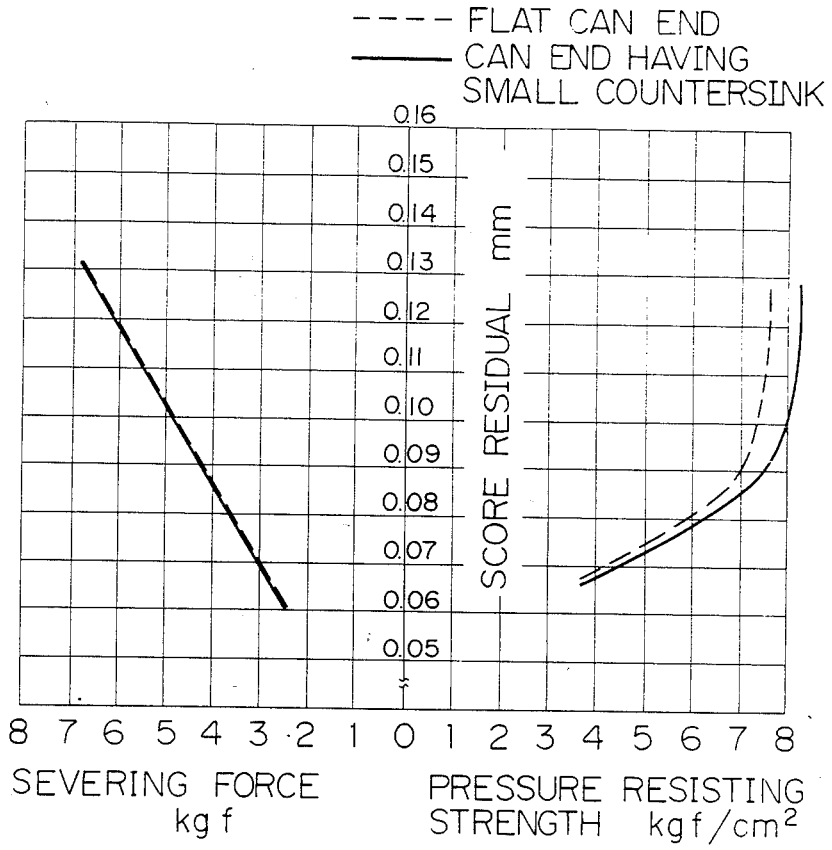
FIG. 13 is a diagram showing the relationship between the severing force of the portion within the score as well as the pressure resisting strength of the can end and the score residual wherein the curve of the solid line indicates the data obtained by the can end having small countersink whereas the curve of the broken line shows the data obtained by the flat can end.

FIG. 13 shows the results of the comparison tests of the above described small countersink type can end having the same numerical properties or the data as those of FIG. 9 with the flat type can end of the same numerical properties or the data as above.

Figure 14:
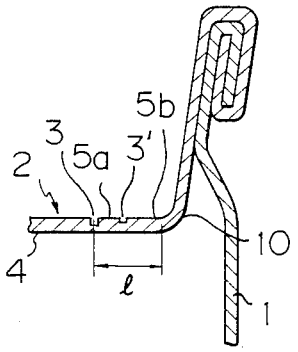
FIG. 14 is a fragmentary enlarged cross-sectional view showing the provision of an auxiliary score between the score for severing the portion defined thereby from the can end and the corner around the bottom of the frustoconical portion of the can end.
Figure 15:
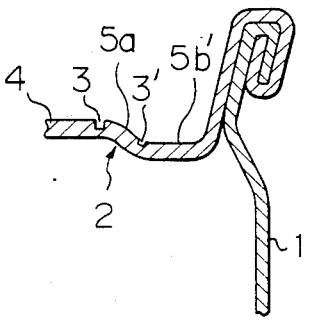
FIG. 15 is a cross-sectional view similar to FIG. 14 but showing the state of the can end when an increased internal pressure is applied thereto.

FIG. 14 shows the modified form of the can end 2 wherein an auxiliary score 3' is arranged between the corner 10 and the main or severing score 3. The auxiliary score 3' has a thicker score residual in comparison with that of the main score 3. The auxiliary score 3' greatly serves to render the can end 2 to be easily deformed in the form of the countersink type when an increased internal pressure is applied thereto as shown in FIG. 15, wherein the inner annular portion 5*a* is deformed in the convex form toward upward, while the outer annular portion 5*b* is left non-deformed, thereby permitting the pressure resisting strength to be increased.

Figure 16:
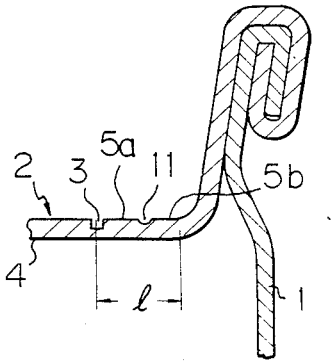
FIG. 16 is a cross-sectional view similar to FIG. 14 but showing an annular groove having a semi-circular cross-section provided in place of the auxiliary score shown in FIG. 12.

FIG. 16 shows a further modified form of the can end 2, wherein the auxiliary score 3' of FIG. 14 is replaced by an annular groove 11 having the cross-section of substantially semi-circular form, the residual thickness at the groove 11 being greater than the score residual of the main score 3. The function of the groove 11 is the same as that of the auxiliary score 3'.

Figure 17:
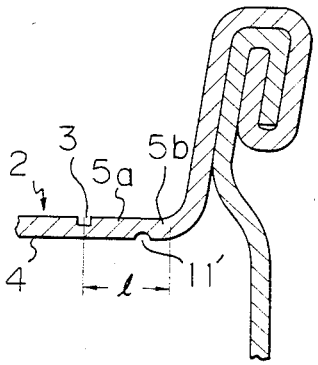
FIG. 17 is a cross-sectional view similar to FIG. 16 but showing a modified embodiment of the groove located in the inside surface of the can end.

FIG. 17 shows an alternative form of the can end 2 shown in FIG. 16, wherein the annular groove 11' is formed in the inner surface of the can end 2. The function of the groove 11' is the same as that of the groove 11.

Figure 18:
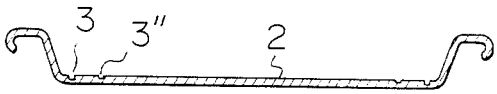
FIG. 18 is a cross-sectional view showing the can end wherein an auxiliary score is formed within the area defined by the score for severing the portion formed thereby.

FIG. 18 shows a further embodiment of the can end 2, wherein an auxiliary score 3'' is formed within the area defined by the severing score 3 so as to permit the annular portion defined by the main score 3 and the auxiliary score 3'' to be deformed and prevent a high stress from being concentrated locally to the severing score 3 when an increased internal pressure is applied to the can end 2.

Figure 19:
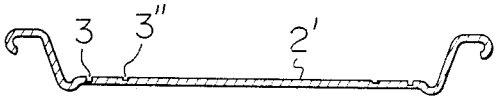
FIG. 19 is a cross-sectional view similar to FIG. 18 but showing a relatively large countersink type can end instead of the can end shown in FIG. 18.

FIG. 19 shows a modified form of the can end 2 wherein the auxiliary score 3'' is formed in the can end 2' of the countersink type.

Figure 20:
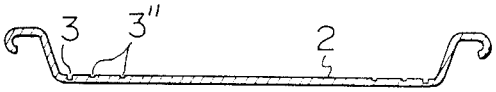
FIG. 20 is a cross-sectional view similar to FIG. 18 but showing a plurality of auxiliary scores provided within the area defined by the severing score.

FIG. 20 shows the other embodiment in which a plurality of auxiliary scores 3'' (two scores 3'' in the illustrated embodiment) formed within the area defined by the severing score 3.

Figure 21:
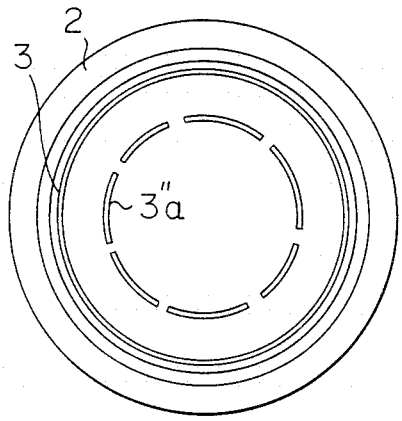
FIG. 21 is a plan view showing an auxiliary score in the form of a broken line instead of the form of the continuous line shown in FIG. 18.

FIG. 21 shows the auxiliary score 3''*a* which is in the form of broken line instead of the score 3'' in the form of a continuous line.

Figure 22:
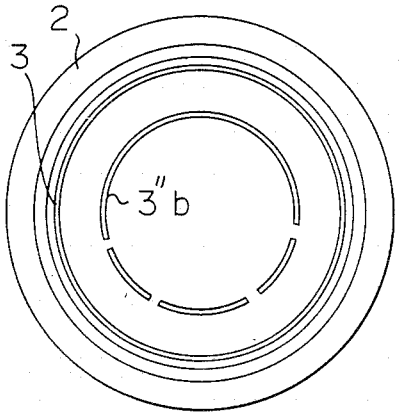
FIG. 22 is a plan view similar to FIG. 21 but showing an auxiliary score wherein a part of the auxiliary score is made in the form of a broken line.

FIG. 22 shows the modification of the score 3''*b* wherein a portion thereof is in the form of a broken line while the remaining portion is in the form of the continuous line.

Figure 23:
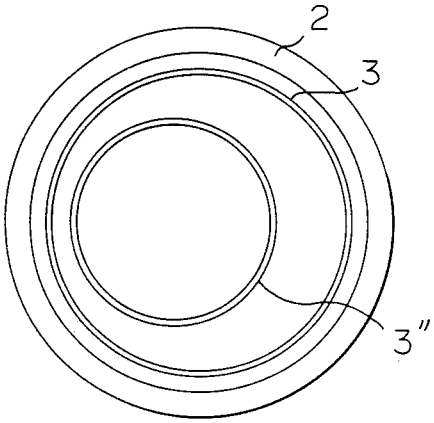
FIG. 23 is a plan view similar to FIG. 21 but showing the auxiliary score in the form of a continuous line located eccentrically with respect to the severing score.

FIG. 23 shows a further modification of the score 3'' which is located eccentrically with respect to the severing score 3. The distance between the severing score 3 and the score 3'' at the minimum distance therebetween is selected to be in the range of 3.2–15 mm as follows.

The present inventors have made a numerous pressure resisting tests (pressure resisting strength of 5.0 kgf/cm$^2$) for finding out the optimum conditions for forming the auxiliary score 3'', 3''*a* and 3''*b* in order to most effectively increase the pressure resisting strength of the can end, wherein the score residual at the severing score 2 was 0.11 mm, the score residual at the auxiliary score was 0.16 mm and the material of the can end had the yield strength $\sigma_{0.2}$ greater than 27.4 kgf/mm$^2$.

The results are as follows:

| Distance between the scores (mm) | 1 | 2 | 3 | 3.2 | 4 | 5 | 6 | 7 . . . 15 | 16 |
|---|---|---|---|---|---|---|---|---|---|
| Results | N | N | N | — | G | G | G | G G | N |

where:
N indicates non-effective
—indicates sometimes effective but sometimes non-effective
G indicates effective.

From the above, it is determined that the distance between the severing score 3 and the auxiliary score 3'', 3''*a* or 3''*b* should be in the range of 3.2 mm and 15 mm.

Figure 24:
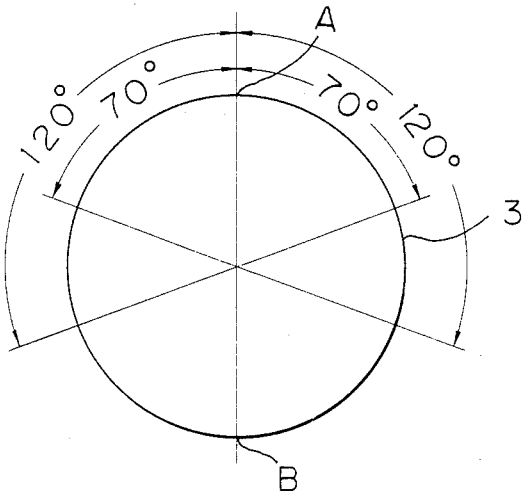
FIG. 24 is a plan view showing the score of the can end wherein the score residual of the can end is the thinnest at the point A and increases toward the point B in both directions along the score.

In the present invention, it has been found out that the score residual of the can end is preferably made the thinnest at a point A as shown in FIG. 24 which is located at a position adjacent to the rivet 9 which secures the tab 8 to the can end 2 as shown in FIG. 3 and the score residual is increased gradually in both directions along the score 3 toward the point B most remote from the position A.

The score residual at the point A may be preferably 0.12 mm and that at the point B may be preferably 0.17 mm, for example.

The variation in the amount of the score residual may be made stepwise as shown in FIG. 24, in which the range of 70° to 120° on both sides from the point A is made 0.12 mm, for example, and the score residual at the remaining portion is made 0.17 mm, for example. By varying the score residual as described above, when the area 4 is being severed by pulling the tab 8 apart from the can end the force to be applied to the tab 8 is gradually increased as the severing proceeds from the point A toward the point B, due to the increase in the score residual so that rapid opening of the can end is prevented so as to avoid spilling of the content out of the can.

Figure 25:
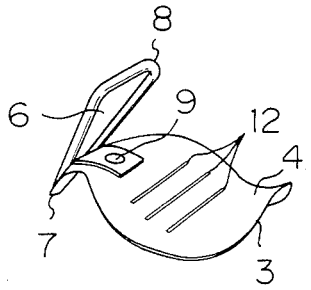
FIG. 25 is a fragmentary perspective view showing the manner in which the area to be severed from the can end is bent about the ridges formed in the area to be severed from can end.

Finally, as shown in FIG. 25, a plurality of elongated parallel ridges or recessed grooves 12 may be formed within the area 4 preferably at the center thereof, perpendicular to the line passing through the sharpened tip 7 and the gripping hole 6 of the tab 8 when it is placed in contact with the can end. By providing such ridges or grooves 12, the area 4 can be gradually severed starting from the point adjacent to the sharpened tip 7 of the tab 8 so that the area 4 is gradually bent about the ridges or grooves 12 to easily assume the outwardly concave form when the tab 8 is pulled apart from the can thereby avoiding rapid opening of the can end to prevent the content from being spilled.

If no ridges or grooves 12 are formed in the can end, since the can end tends to be held in the outwardly convex form in order to enhance the internal pressure resisting strength, the area 4 might be rapidly severed at once as a whole from the can end thereby causing spilling of the content out of the can, because the area 4 tends to be kept in the flat form or in the outwardly convex form until it is completely severed from the can end.

We claim:

1. In a can end of an aluminum alloy can consisting of a body having a closed bottom and an upper open end and made of a thin aluminum alloy sheet and said can end made of a thin aluminum alloy sheet with the peripheral edge thereof being sealingly curled together with the periphery of said upper open end of said body so as to form an upwardly diverging frustoconical portion along the periphery of said can end thereby forming a hermetically sealed vessel adapted to sealingly contain therein pressurized liquid such as carbonated beverage or beer, said can end being formed with a circular score within the area of said can end along the periphery thereof so as to form a severable portion from said can end, a manipulating tab being secured at an appropriate portion thereof to said can end within the area defined by said circular score adjacent thereto so as to permit the area defined by said score to be severed from said can end by pulling said manipulating tab apart from said can end, the improvement wherein said aluminum alloy sheet forming said can end is so regulated that it has the yield strength in the range of 24–29 $kgf/mm^2$ and the elongation equal to or greater than 6%, while the aperture rate defined by the ratio of the area defined by said score with respect to the total area of said can end is selected to be at least equal to or greater than 60%, so that the pressure resisting strength of said can end is kept to be substantially at least 5 $kgf/cm^2$, said score being spaced from the corner formed around the bottom of said frustoconical portion at least a distance equal to or greater than 1 mm inwardly of the area of said can end, the inner radius of curvature of said corner being selected to be equal to or less than 0.5 mm.

2. An aluminum alloy can end according to claim 1, wherein the taper angle of said diverging frustoconical portion is selected to be equal to or less than 10°.

3. An aluminum alloy can end according to claim 1, further comprising an auxiliary score formed between said score for severing said area from said can end and said corner formed around the periphery of the bottom of said frustoconical portion, the score residual of said auxiliary score being made greater than that of said score for severing.

4. An aluminum alloy can end according to claim 1, further comprising an auxiliary score being formed within the area defined by said score for severing the area therein from said can end, the distance between said auxiliary score and said score for severing said area at the minimum distance therebetween being selected to be in the range of 3.2 to 15 mm, the score residual of said auxiliary score being made greater than that of said score for severing.

5. An aluminum alloy can end according to claim 1, wherein the score residual of said score for severing said area from said can end is the smallest at the position adjacent to the portion to which said tab is secured and said score residual is increased continuously or stepwise in both peripheral directions along said score toward the position most remote from said adjacent position.

6. An aluminum alloy can end according to claim 1, further comprising a plurality of parallel elongated ridges or recessed grooves provided in the area within said score, said ridges or grooves being oriented substantially perpendicular to the line passing through said sharpened tip and said gripping hole of said tab or the center of said can end.

* * * * *